US012031744B1

(12) United States Patent
Hatton

(10) Patent No.: US 12,031,744 B1
(45) Date of Patent: Jul. 9, 2024

(54) UPBLAST RAIN CAP

(71) Applicant: Vapor Dynamics LLC, Blairstown, NJ (US)

(72) Inventor: Thomas E. Hatton, Blairstown, NJ (US)

(73) Assignee: Vapor Dynamics LLC, Blairstown, NJ (US)

( * ) Notice: Subject to any disclaimer, the term of this patent is extended or adjusted under 35 U.S.C. 154(b) by 217 days.

(21) Appl. No.: 17/093,931

(22) Filed: Nov. 10, 2020

Related U.S. Application Data

(60) Provisional application No. 62/934,034, filed on Nov. 12, 2019.

(51) Int. Cl.
*F24F 13/20* (2006.01)
*F24F 7/02* (2006.01)

(52) U.S. Cl.
CPC ..... *F24F 13/20* (2013.01); *F24F 7/02* (2013.01); *F24F 2221/52* (2013.01)

(58) Field of Classification Search
CPC ..... F24F 13/20; F24F 7/02; F24F 2221/52; F24F 1/56; F24F 1/58; F24F 13/082; E04D 13/0325
USPC ..... 454/1–47
See application file for complete search history.

(56) References Cited

U.S. PATENT DOCUMENTS

| | | | | |
|---|---|---|---|---|
| 317,718 A | | 5/1885 | Burkhardt | |
| 322,832 A | * | 7/1885 | Kittoe | F24F 7/02 49/347 |
| 715,169 A | | 12/1902 | Stanley | |
| 985,148 A | | 2/1911 | Cummings | |
| 1,098,948 A | * | 6/1914 | Hodel | F23L 17/02 454/12 |
| 1,955,176 A | | 4/1934 | Dearing | |
| 2,114,164 A | | 4/1938 | Bührer | |
| 2,127,100 A | | 8/1938 | Whitaker | |

(Continued)

FOREIGN PATENT DOCUMENTS

| | | |
|---|---|---|
| FR | 2 533 672 A1 | 2/1983 |
| GB | 483490 A | 4/1938 |

OTHER PUBLICATIONS

Riggenbach, Mr., "Radon Mitigation System Installation." Feb. 2011, https://threethingsverydullindeed.blogspot.com/2011/02/radon-mitigation-system-installation.html, FIG. 11. (Year: 2011).*

(Continued)

*Primary Examiner* — Allen R. B. Schult
*Assistant Examiner* — William C Weinert
(74) *Attorney, Agent, or Firm* — Myers Wolin, LLC

(57) ABSTRACT

An upblast rain cap may have an inverted bottom cone joined to a top cap. The wall of the bottom cone is at an angle of less than 45 degrees with respect to a vertical axis. The joined cone and cap are held above a lower support coupler by a spar. The height of the bottom cone above the support coupler forms a side discharge area. The coupler attaches to the top of a vertical conveyance pipe through which exhaust air flows. A gutter is formed around the edge of the top cap. The gutter has a vertical opening that is aligned with the top of the spar. When rain falls, water flows over the top cap to the gutter, through the opening in the gutter, down the outside edge of the spar and down the outside of the support coupler.

11 Claims, 2 Drawing Sheets

(56) References Cited

U.S. PATENT DOCUMENTS

| | | | | |
|---|---|---|---|---|
| 2,422,855 | A | 6/1947 | Rutter | |
| 2,909,113 | A * | 10/1959 | Hatcher | E04D 13/1471 138/120 |
| 3,719,032 | A * | 3/1973 | Cash | B01D 47/10 417/155 |
| 4,462,305 | A | 7/1984 | Amphoux | |
| 4,603,619 | A | 8/1986 | Amphoux | |
| 5,816,288 | A | 10/1998 | Zelch | |
| 6,954,947 | B1 | 10/2005 | Williams, Jr. | |
| 7,048,499 | B2 * | 5/2006 | Mathson | F04D 17/06 415/206 |
| 8,052,386 | B1 * | 11/2011 | Fitzpatrick | F04D 29/30 415/218.1 |
| 2006/0111034 | A1 * | 5/2006 | Parry | F23L 17/02 454/3 |
| 2013/0295837 | A1 | 11/2013 | Bailey | |
| 2018/0017251 | A1 * | 1/2018 | Lisowski | F23M 9/006 |
| 2022/0057090 | A1 * | 2/2022 | King, Jr. | F24F 7/02 |

OTHER PUBLICATIONS

HVAC Express (Roof Rain Cap(12 Inch) (GCT 12)—Ducting Components—Amazon.com. https://www.amazon.com/Roof-Rain-Cap-Inch-GCT/dp/B00BBMQA28, FIG. 2. (Year: 2013).*

Machine translation of FR 2 533 672 A1, "Two-part chimney cowl and cover" filed Feb. 10, 1983 by Superpart AG.

"The Complete Guide to Upblast Exhaust Fans" by The Hood Supply Superstore, HoodFilters.com, last viewed Aug. 7, 2019.

En. Wikipedia.org, "Airfoil", https://en.wikipedia.org/wiki/Airfoil last viewed Oct. 30, 2020.

ANSI/AARST, An American National Standard, "Soil Gas Control Systems in New Construction of Buildings", CC-1000 2018, last viewed Oct. 27, 2020.

InterNACHI®, "Radon System Rain Cap", https://www.nachi.org/gallery/radon/radon-system-rain-cap, last viewed Oct. 27, 2020.

"Three Things Very Dull Indeed: Radon Mitigation System Installation" dated Feb. 28, 2011, https://threethingsverydullindeed.blogspot.com/2011/02/radon-mitigation-system-installation.html, last viewed Oct. 27, 2020.

* cited by examiner

UPBLAST RAIN CAP

BACKGROUND

The American National Standards Institute (ANSI) and American Association of Radon Scientists and Technologists (AARST) have jointly issued standard CC-1000 2018 for "Soil Gas Control Systems in New Construction of Buildings". This standard requires that for active soil depressurization systems, contaminated air from below a building be upblast vented at an angle of not more than 45 degrees from an upward vertical direction. This is so that air contaminated with vapors, particulates or radioactive materials (e.g. Radon) are less likely to be drawn back into a building. Vertically directed conveyance pipes with open ends, however, are subject to water entering the open ends when it rains. Caps can be placed over the open ends, but these tend to direct the vented air at an angle of more than 45 degrees from the vertical. There is need, therefore, for an upblast rain cap that will minimize rain water entering a vertical conveyance pipe without causing the vented air to depart more than 45 degrees from the vertical.

SUMMARY OF INVENTION

The summary of the invention is a guide to understanding the invention. It does not necessarily describe the most generic embodiment.

FIG. 1A is a side elevational view of an upblast rain cap 100. The upblast rain cap may comprise:

a) an inverted bottom cone 102 comprising:
   i) a wall 128;
   ii) a lower apex 104; and
   iii) an upper base 109;
b) a top cap 106 comprising:
   i) a wall 129;
   ii) an apex 113; and
   iii) a base 110;
c) a gutter 122 comprising a vertical gap 124;
d) a generally vertical spar 108; and
e) a lower support coupler 112 comprising an upper edge 126 with a horizontal open area 154.

wherein:

f) said upper base of said bottom cone is joined to said base of said top cap to form a seal 164;
g) said wall of said bottom cone is inclined at an angle 103 of not more than 45 degrees relative to a vertical axis 105;
h) said spar joins said bottom cone to said lower support collar at height 123 such that a side discharge area 152 is formed between a lower attachment level 127 of said spar to said bottom cone and said upper edge 126 of said lower support coupler; and
i) said vertical gap in said gutter is aligned with said vertical spar such that rain water falling on said top cap will flow to said gutter and through said vertical gap to be drained down 117 said vertical spar to an outside of said lower support coupler.

DETAILED DESCRIPTION

The detailed description describes non-limiting exemplary embodiments. Any individual features may be combined with other features as required by different applications for at least the benefits described herein. As used herein, the term "about" means plus or minus 10% of a given value unless specifically indicated otherwise.

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

As used herein, the term "shaped" means that an item has the overall appearance of a given shape even if there are minor variations from the pure form of said given shape.

As used herein, the term "generally" when referring to a shape means that an ordinary observer will perceive that an object has said shape even if there are minor variations from said shape.

As used herein, relative orientation terms, such as "up", "down", "top", "bottom", "left", "right", "vertical", "horizontal", "distal" and "proximal" are defined with respect to an initial presentation of an object and will continue to refer to the same portion of an object even if the object is subsequently presented with an alternative orientation, unless otherwise noted.

Figure 1A:
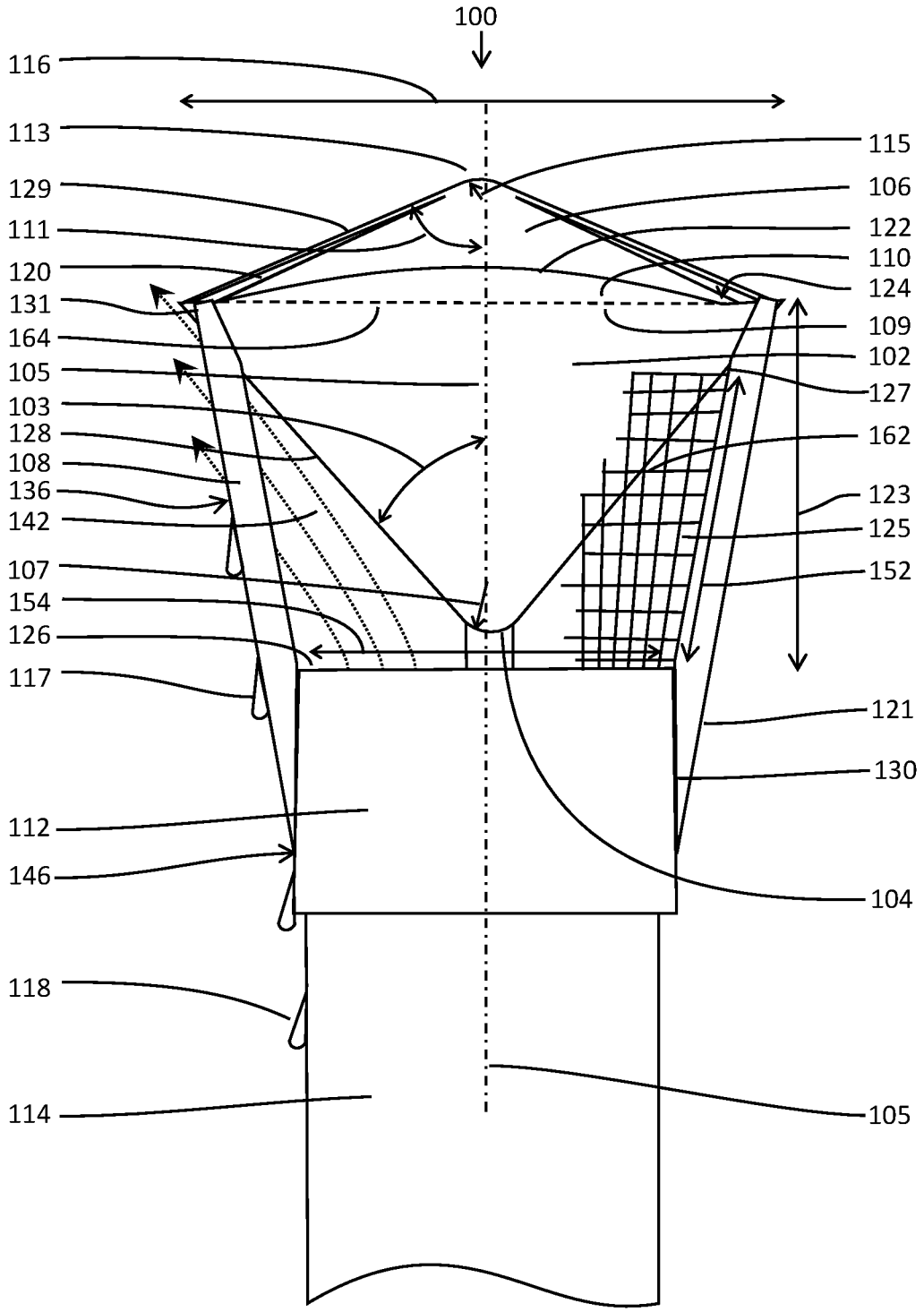
FIG. 1A is an elevational side view of an upblast rain cap.
Figure 1B:
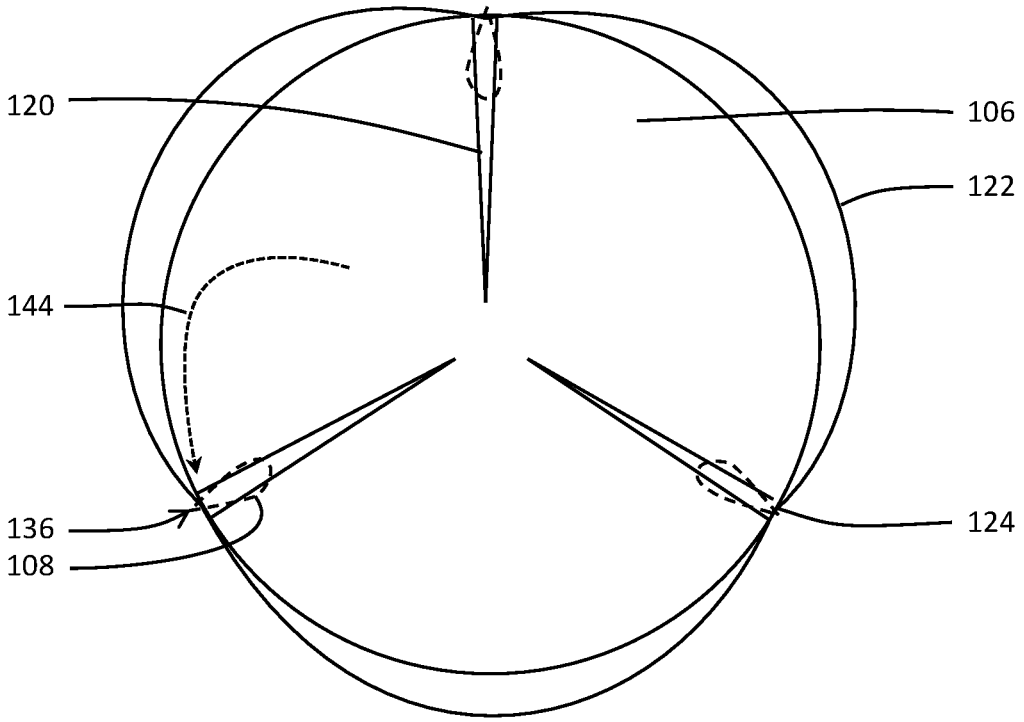
FIG. 1B is a plan view of the upblast rain cap of FIG. 1A.
Figure 1C:
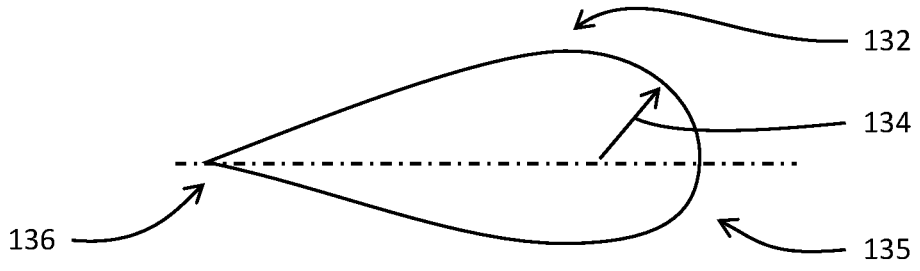
FIG. 1C is a horizontal cross section of a spar.

Referring to FIGS. 1A, 1B and 1C, an upblast rain cap 100 may comprise an inverted bottom cone 102. The wall 128 of the bottom cone has an angle 103 that is less than 45 degrees with respect to a vertical axis 105. The vertical axis may be an axis of a vertical conveyance pipe 114. A lower apex 104 of the bottom cone may be located at about said vertical axis. The lower apex of the bottom cone may have a radius of curvature 107. The radius of curvature may have any value including zero (i.e. the apex is a sharp point). The radius of curvature can be selected by experimentation to create a minimal back pressure on exhaust air 142 flowing up out of the conveyance pipe.

An upper base 109 of the bottom cone may have a round horizontal cross section. In other embodiments, the cone may have other cross-sectional shapes, such as square, triangular, hexagonal, octagonal, polygonal, oval, or elliptical, that fulfill the function of the cone. The horizontal cross section of the base may be carried through the rest of the cone. Thus, for example, all horizontal cross sections of the bottom cone may be squares such that the bottom cone may be made from four flat triangular pieces of sheet material. Other cross sections may be made from a plurality of flat pieces of sheet material. The flat pieces may be joined edge to edge. The top cap may similarly by made from a plurality of flat pieces of sheet material joined edge to edge.

The cone may be off center from the axis of the vertical conveyance pipe or at an angle with respect to the axis of the conveyance pipe provided that the open area 154 of an upper edge 126 of the support coupler is vertically covered and the wall of the bottom cone is not inclined at more than 45 degrees from the vertical axis.

An upblast rain cap may further comprise a top cap 106 that is joined at its base 110 to the upper base 109 of the bottom cone to form a seal 164. The top cap may have a generally conical shape with its base having a horizontal cross section that generally matches the cross section of the upper base of the bottom cone such that the two bases can be joined without gaps. This will prevent precipitation water from flowing into the bottom cone. The apex 113 of the top cap may have a radius of curvature 115. The radius of curvature can be any value including zero.

The angle 111 of the wall 129 of the top cap with respect to the vertical axis 105 is such as to minimize the surface area of the top cap while fulfilling certain functions. In some embodiments, the angle 111 of the wall of the top cap with respect to the vertical axis 105 can be approximately 60 degrees or greater.

The function of a low-profile top cap is to limit the surface area that will contact and catch rain and limit the area that will hold ice and snow while still having enough slope to shed water, ice and snow. Because discharged soil gas is typically approximately 55 degrees Fahrenheit, even in winter months, ice and snow accumulation in most varying climates is anticipated to be small since the exhaust air flowing up and around the top cap will melt any accumulation.

The joined bottom cone and top cap may be supported by one or more generally vertical spars 108. The generally vertical spars may be an angle with respect to the vertical axis 105 such that they will connect an outer surface 130 of the support coupler to an outer edge 131 of the joined top cap and bottom cone.

The support coupler 112 is dimensioned to fit over and attach to a generally vertical conveyance pipe 114. The support coupler may be attached to the conveyance pipe by fasteners, glue, or any other attachment means. The support coupler may have a generally cylindrical shape. Any form of coupler, such as bolting the spars directly to the conveyance pipe, may be used. In that case, the upper edge 126 of the coupler is the upper edge of the conveyance pipe and the open area 154 of the coupler is the open area of the top of the conveyance pipe.

There may be one or more angled vertical support spars. Three or four spars would provide improved support of the cone and cap. Any number of spars may be used. The spars may be in the form of a screen.

Some embodiments may have directional ridges or gutters 122 around the perimeter of the upper cap. There may be vertical gaps 124 in the ridges to direct the flow of water. The function of these ridges will be to serve as gutters or channels that will direct rainwater from the top of the cap toward the outer edge of the cap in alignment with the tops of the support spars.

Because rainfall is rarely perpendicular to the ground but falls on an angle that is subject to the wind speed and direction, having a lower profile top cap enables rain to travel past the cap instead of intersecting by contact with a high slope cone with greater surface area.

For efficient rain cover, the horizontal cross-sectional area 116 of the base of the top cap should be approximately 80 percent greater than the area 154 of the horizontal opening of the coupler.

Referring to FIG. 1C, the cross-sectional shape 132 of the vertical spar may be an oblong oval or airfoil shape. The cross section of the vertical spar may comprise a rounded inner face 135 with a radius of curvature 134. The inner face may face the discharge airstream 142 (FIG. 1A) and may be close to a half circle. The cross section of the vertical spar may further comprise an outer edge 136 with a much smaller radius of curvature. The geometry of the cross section of the spar is similar to that of an airplane wing support spar. Other cross sections may be suitable, such as round, oval, square, and polygonal.

Referring to FIGS. 1A and 1B, when the exhaust airstream 142 contacts the bottom cone 102, it is deflected outward but maintains a generally vertical direction. When this air contacts a spar 108, it flows around it in a manner that will induce a negative pressure or vacuum on the back or outer edge 136 of the spar.

During precipitation, water 144 from the top of the cap 106 will be directed by gutters or ridges 122 to an outer edge of the cap. It will then flow through the vertical gap 124 at the spar intersection. One or more grooves 120 or ridges may be provided in the top cap in alignment with the spars to further direct water to the spars. The grooves 120 may be oriented radially. The groves may be narrow or wider directional slopes so long as water is directed toward the gap in the gutters. Water surface tension and the vacuum that is induced by the air flowing around the oblong spar will direct water 117 to the outer edge of the spar where it will flow down. The water will then run onto the outer surface 130 coupler 112 at the lower attachment point 146 of the spar to the coupler. The base 121 of the spar may be tapered to help convey the water to the outer surface of the coupler. Water will continue to run down 118 the exterior of the pipe or discharge duct away from the exhaust air stream.

The height 123 of the bottom cone above the top edge 126 of the coupler should be such that a side discharge area 152 of the exhaust air is greater than the horizontal open area 154 of the support coupler. The side discharge area may be defined as the area of a conical section joining the lower attachment level 127 of the vertical spars to the wall of the bottom cone and the upper edge 126 of the lower support coupler. Having the side discharge area larger than the horizontal open area of the coupler helps to minimize back pressure within the venting system.

Some embodiments may have a frustoconical discharge screen 162 just inboard of the vertical spars and covering the side discharge area. Only a portion of the screen is shown in FIG. 1A for clarity. The screen connects the top edge 126 of the lower support coupler 112 to the level of the wall 128 of the bottom cone 102 at about the lower attachment point 127 of the vertical spar. The function of the screen is to keep animals and debris from entering the conveyance pipe system. Other screen configurations, such as a cylindrical configuration, may be used.

In some embodiments, the screen itself may serve as the spars such that there is only a screen connecting the bottom cone to the lower support coupler. The vertical wires 125 of the screen serve as the spars.

The upblast rain cap can be constructed of any material suitable for exposure to the outdoor environment. Suitable materials include metals, such as galvanized steel, copper, aluminum; and plastics, such as polyvinyl chloride (PVC). An advantage of PVC for the support coupler is that it can be glued to a PVC conveyance pipe.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

I claim:

1. An upblast rain cap comprising:

a) an inverted bottom cone comprising:

i) a wall;

ii) a lower apex; and
iii) an upper base;

b) a top cap comprising:
i) a wall;
ii) an apex; and
iii) a base;

c) a gutter around a perimeter of the top cap and comprising a gap;

d) a generally vertical spar; and e) a lower support coupler comprising an upper edge with a horizontal open area;

wherein:

f) said upper base of said bottom cone is joined to said base of said top cap to form a seal;

g) said wall of said bottom cone is inclined at an angle of not more than 45 degrees relative to a vertical axis;

h) said spar joins said bottom cone to said lower support coupler at height such that a side discharge area is formed between a lower attachment level of said spar to said bottom cone and said upper edge of said lower support coupler; and i) said gap in said gutter is aligned with said vertical spar such that rain water falling on said top cap will flow to said gutter and through said gap to be drained down said vertical spar to an outside of said lower support coupler;

wherein a cross section of said vertical spar comprises a rounded inner face and a rounded outer edge with a smaller radius of curvature than that of the inner face, such that air traveling around the spar will create a lower pressure on the outer edge than the inner face of the vertical spar and the lower pressure causes the rain water to flow in a direction that is away from the lower support coupler.

2. The upblast rain cap of claim 1 wherein:

a) said upblast rain cap comprises three or more vertical spars;

b) said gutter comprises three or more gaps; and c) said gaps are aligned with said vertical spars.

3. The upblast rain cap of claim 1 wherein said side discharge area is greater than said horizontal open area of said lower support coupler.

4. The upblast rain cap of claim 1 wherein said top cap comprises a radial groove aligned with said vertical spar.

5. The upblast rain cap of claim 1 wherein said side discharge area is covered by a screen.

6. The upblast rain cap of claim 1 which comprises one or more of a metal or a plastic.

7. The upblast rain cap of claim 6 wherein said plastic is a polyvinyl chloride.

8. The upblast rain cap of claim 1 wherein a horizontal cross-sectional area of the base of said top cap is at least 80% larger than said horizontal open area of said lower support coupler.

9. The upblast rain cap of claim 1 wherein an angle between said wall of said upper cap and said vertical axis is 60 degrees or greater.

10. The upblast rain cap of claim 1 wherein said upper base of said bottom cone has a horizontal cross section of:

a) a square;
b) a triangle;
c) a hexagon;
d) an octagon;
e) a polygon;
f) an oval; or
g) an ellipse.

11. The upblast rain cap of claim 1 wherein the bottom cone is made from a plurality of flat pieces of sheet material.

* * * * *